US010821469B2

(12) United States Patent
Grontved

(10) Patent No.: US 10,821,469 B2
(45) Date of Patent: Nov. 3, 2020

(54) TWO-COMPONENT DISPENSER

(71) Applicant: Sulzer Mixpac AG, Haag (CH)

(72) Inventor: Martin Grontved, Haarlev (DK)

(73) Assignee: SULZER MIXPAC AG, Haag (CH)

( * ) Notice: Subject to any disclaimer, the term of this patent is extended or adjusted under 35 U.S.C. 154(b) by 98 days.

(21) Appl. No.: 16/301,846

(22) PCT Filed: Apr. 27, 2017

(86) PCT No.: PCT/EP2017/060105
§ 371 (c)(1),
(2) Date: Nov. 15, 2018

(87) PCT Pub. No.: WO2017/207190
PCT Pub. Date: Dec. 7, 2017

(65) Prior Publication Data

US 2019/0283074 A1 Sep. 19, 2019

(30) Foreign Application Priority Data

May 31, 2016 (EP) ..... 16172167

(51) Int. Cl.
*B05C 17/005* (2006.01)
*B05C 17/01* (2006.01)

(52) U.S. Cl.
CPC .... *B05C 17/00553* (2013.01); *B05C 17/0126* (2013.01)

(58) Field of Classification Search
CPC ..... B05C 17/00553; B05C 17/00593; B05C 17/01; B05C 17/0116; B05C 17/012; B05C 17/0123; B05C 17/0126
See application file for complete search history.

(56) References Cited

U.S. PATENT DOCUMENTS 2,732,102 A * 1/1956 Ekins ..... B05C 17/0126 222/327
3,311,265 A * 3/1967 Creighton, Jr. ... B05C 17/00516 222/137

(Continued)

FOREIGN PATENT DOCUMENTS

DE 102006035476 A1 6/2008
EP 2402092 A1 1/2012

OTHER PUBLICATIONS

International Search Report dated Jul. 6, 2017 in corresponding International Application No. PCT/EP2017/060105, filed Apr. 27, 2017.

(Continued)

*Primary Examiner* — Patrick M. Buechner
(74) *Attorney, Agent, or Firm* — Global IP Counselors, LLP

(57) ABSTRACT

A two-component dispenser includes first and second push rods guided within the two-component dispenser, first and second drive plate assemblies respectively associated with and embodied for engaging with the first and second push rods, and an actuation mechanism symmetrically arranged with respect to the first and second push rods and with respect to the first and second drive plate assemblies. The actuation mechanism displaceable in a linear manner between a release position and a plurality of dispensing positions and engaging the first and second drive plate assemblies in the dispensing positions to lock the first and second push rods by engagement with the first and second drive plate assemblies and to entrain the first and second push rods in a dispensing direction of the two-component dispenser.

20 Claims, 6 Drawing Sheets

(56) References Cited

U.S. PATENT DOCUMENTS 4,471,888 A 9/1984 Herb et al.
4,566,610 A 1/1986 Herb
4,869,400 A * 9/1989 Jacobs ..... B05C 17/00506 222/137
4,911,328 A 3/1990 Keller
5,137,181 A 8/1992 Keller
5,197,635 A * 3/1993 Chang ..... B05C 17/00553 222/137
5,263,614 A * 11/1993 Jacobsen ..... B05C 17/00513 222/137
5,314,092 A * 5/1994 Jacobsen ..... B05C 17/00513 222/137
5,386,931 A * 2/1995 Jacobsen ..... B05C 17/00513 222/327
5,390,831 A * 2/1995 Schneider ..... B05C 17/01 222/137
5,392,956 A 2/1995 Keller
5,441,175 A * 8/1995 Jacobsen ..... B05C 17/00553 222/137
5,464,131 A 11/1995 Keller
5,511,699 A * 4/1996 Tepic ..... B05C 17/01 222/326
5,720,418 A * 2/1998 Timmerman ..... B05C 17/00553 222/309
6,766,923 B1 * 7/2004 Huang ..... B05C 17/01 222/327
6,938,799 B1 9/2005 Berntsen et al.
2005/0072811 A1 * 4/2005 Heiberger ..... B05C 17/015 222/389
2006/0175356 A1 * 8/2006 Takahashi ..... A61C 5/62 222/391
2008/0142551 A1 * 6/2008 Strobel-Schmidt ..... B05C 17/012 222/333
2012/0031931 A1 2/2012 Strobel-Schmidt et al.
2018/0056324 A1 * 3/2018 Springhorn ..... B05C 17/00586
2018/0142551 A1 5/2018 Zheng et al.

OTHER PUBLICATIONS

Extended European Search Report dated Nov. 18, 2016 in corresponding European Application No. 16172167.5, filed May 31, 2016.

* cited by examiner

TWO-COMPONENT DISPENSER

CROSS-REFERENCE TO RELATED APPLICATION

This application is a U.S. National Stage application of International Application No. PCT/EP2017/060105, filed Apr. 27, 2017, which claims priority to European Patent Application No. 16172167.5, filed May 31, 2016, the contents of each of which are hereby incorporated herein by reference.

BACKGROUND

Field of the Invention

The present invention relates to a two-component dispenser comprising first and second push rods guided within the two-component dispenser; and first and second drive plate assemblies respectively associated with and embodied for engaging with the first and second push rods.

Background Information

In general, two-component (2K) dispensers are challenged with equally dispensing both components of a cartridge installed in the dispenser at the same speed. With regard to side-by-side cartridges, there are two plungers present in the dispenser that are configured to push two pistons of the cartridge in order to dispense some of the content from the cartridge. Frequently only one of the plungers is actively driven by the dispenser. The second plunger is connected with the first plunger but this connection is often not rigid enough to ensure simultaneous advancement of the two pistons. If the two-components are not dispensed in an accurate manner the mixing ratio of the two-components cannot be maintained and the desired bond between the compounds cannot be achieved.

Designs exist in the prior art that actively drive both plungers, however, these designs use complex and expensive mechanisms to actively drive both plungers of the dispenser.

SUMMARY

For this reason it is an object of the invention to provide a dispenser in which both plungers are driven simultaneously, which satisfies the demand for accuracy in dispensing, and which is simple to manufacture in order to reduce the cost of manufacture and the number of components used.

This object is satisfied by a two-component dispenser having the features described herein.

In this regard one embodiment of a two-component dispenser, such as a caulking gun, comprises first and second push rods guided within the two-component dispenser;

first and second drive plate assemblies respectively associated with and embodied for engaging with the first and second push rods; and an actuation mechanism (actuator) symmetrically arranged with respect to the first and second push rods and with respect to the first and second drive plate assemblies, wherein the actuation mechanism can be displaced in an at least substantially linear manner between a release position and a plurality of dispensing positions and with the actuation mechanism engaging the first and second drive plate assemblies in the plurality of dispensing positions to respectively lock the first and second push rods by engagement with the first and second drive plate assemblies and to entrain the first and second push rods in a dispensing direction of the two-component dispenser.

In this way both push rods are simultaneously and actively driven by the actuation mechanism. Moreover, comparatively simple parts comprising push plates are used and not a significantly more cost intensive ratchet mechanism, as is known from the prior art to achieve such a simultaneously acting drive. This also means that push rods can be employed which are free of surface markings, i.e. one can do without e.g. saw-tooth plungers. Thus, such a two-component dispenser can be manufactured in a cost effective and simple manner and includes a simpler actuation mechanism that drives both plungers evenly.

By symmetrically arranging the actuation mechanism with respect to the first and second push rods and with respect to the first and second drive plate assemblies, these can be acted on in a symmetric manner ensuring a uniform application of force with respect to the first and second drive plate assemblies, so that uniformly driven first and second push rods are obtained.

In this connection it should be noted that the definition relating to the fact that the actuation mechanism is symmetrically arranged with respect to the first and second push rods means that the actuation mechanism is configured such that it is either arranged in a first plane comprising the first and second push rods and indeed centrally between the first and second push rods or is arranged at an equal distance to both of the first and second push rods such that a force respectively applied at the first and second push rods is of at least approximately equal magnitude.

Preferably the first and second push rods are of generally cylindrical shape and the parts of the first and second push rods that are engaged by the first and second drive plate assemblies are free of pre-manufactured surface markings, i.e. these parts do not include any pre-manufactured recesses or protrusions. The ends of the push rods can include a connection element or means, e.g. an inner thread, so that the respective ends of the first and second push rods can be connected to further parts, such as an end plate or drive plate.

In this connection it should be noted that the drive shaft can adopt a plurality of dispensing positions, with the plurality of dispensing positions respectively being provided when the dispenser is in a dispensing state. The dispensing state is present when the actuation mechanism engages the first and second drive plate assemblies to respectively lock the first and second push rods by an engagement, e.g. by clamping, and to entrain the first and second push rods in the dispensing direction. In other words, there are a plurality of consecutive dispensing positions between the first locking of the push rods and an end dispensing position defined by the maximum displacement of the actuation mechanism in the dispensing direction.

In this connection it should be noted that the two-component dispenser is in a release state when the drive shaft is in the release position, i.e. in a state in which no dispensing takes place. Nevertheless, it should be noted that in the release state of the two-component dispenser this can be configured such that the first and second push rods are prevented from being moved in a direction opposite to the dispensing direction.

Preferably the actuation mechanism is symmetrically arranged between the first and second push rods and preferably also between the first and second drive plate assemblies.

It should be noted that the first and second push rods are each configured for displacing a respective piston of a two-component cartridge in the dispensing direction, when the two-component cartridge is present in the two-component dispenser.

It should further be noted that the dispensing direction is the direction in which the push rods are moved during the activation of the two-component dispenser during a dispensing use of the dispenser.

Advantageously the first and second push rods are led through openings present in the first and second drive plate assemblies. This means that a more compact design of the two-component dispenser can be achieved.

It should be noted that in the plurality of dispensing positions the push rods are engaged by the first and second drive plate assemblies to respectively lock the first and second push rods by an engagement and it is only due to the locking of the first and second push rods by the first and second drive plate assemblies that the first and second push rods are entrained in the dispensing direction.

Preferably the actuation mechanism is arranged in a first plane comprising the first and second push rods. In this way, the actuation mechanism can be arranged, preferably directly, between the first and second push rods. Moreover, the actuation mechanism can engage the first and second drive plate assemblies in the same plane as they act.

It should be noted in this connection that the plane can optionally comprise the first and second drive plate assemblies.

Alternatively, the actuation mechanism can be arranged in a second plane or symmetrically with respect to a second plane, with the second plane being arranged transversely with respect to the first and second push rods, i.e. perpendicular to the first plane, and centrally between the first and second push rods.

In this way the actuation mechanism can still engage centrally at the first and second drive plate assemblies and also symmetrically with respect to the first and second push rods, albeit outside of the plane comprising the first and second push rods. Thereby a simple design of the system can be achieved.

In this connection it should be noted that the second plane is the median plane that intersects the plane including the first and second push rods at right angles at a position that is the geometric center between the first and second push rods.

Advantageously the actuation mechanism comprises a driving shaft and at least one push member, in particular a push plate, arranged at or integrally formed with the driving shaft, wherein the driving shaft can be moved to and fro in an at least substantially linear manner between the plurality of dispensing positions and the release position essentially in parallel to the first and second push rods; with the at least one push member engaging the first and second drive plate assemblies in the plurality of dispensing positions of the actuation mechanism.

Providing a substantially linear driven member to engage the first and second drive plate assemblies a more uniform application of force onto the first and second drive plate assemblies is achieved in the plurality of dispensing positions. This force is transmitted by the push member of the actuation mechanism.

Preferably the driving shaft and the push plate are arranged in the plane comprising the first and second push rods. Thereby construction space can be saved regarding the width of the dispenser, making this easier to handle.

It is preferred if the first and second drive plate assemblies are inclined with respect to the first and second push rods in the plurality of dispensing positions of the actuation mechanism, and/or wherein a respective end of the first and second drive plate assemblies that is engaged by the actuation mechanism is deflected in the dispensing direction and the other end of the first and second drive plate assemblies is deflected away from the dispensing direction, so that the first and second drive plate assemblies are deflected in opposite directions.

In this connection it should be noted that the term opposite directions means that the first and second drive plate assemblies are tilted with respect to the first and second push rods in a rotational manner, with the respective rotation having a different orientation, e.g. the first drive plate assembly is deflected in a clockwise direction with respect to the first push rod, whereas the second drive plate assembly is deflected in an anti-clockwise direction with respect to the second push rod in a side view of the first and second drive plate assemblies or vice versa.

Preferably an angle of inclination between the first and second push rods and the first and second drive plate assemblies is in the range of 0 to 85°, in particular 2 to 15°.

It should be noted in this connection that, in the plurality of dispensing positions, a side view of the first and second drive plate assemblies resembles that of an arrow head.

Due to the inclination of the first and second drive plate assemblies with respect to the first and second push rods, these are each locked by at least front and rear openings of the respective push plate assembly.

Advantageously, when the actuation mechanism is in the release position, first and second brake plates respectively lock the first and second push rods and fix the position of the first and second push rods. The first and second brake plates, in particular prevent a movement of the first and second push rods against the dispensing direction when the actuation mechanism is in the release position.

In this way a movement of the first and second push rods can be prevented when the dispenser is not in the dispensing state respectively when the driving shaft is not in one of the plurality dispensing positions. This can prevent the first and second push rods from travelling in a direction opposite of the dispensing direction.

In this connection it should be noted that designs could be provided in which travel of the first and second push rods in the dispensing direction could also be prevented by the first and second brake plates.

Again, the push rods can each be locked by at least front and rear openings of the respective brake plate. It should also be noted that to prevent movement of the first and second push rods, the first and second brake plates can be inclined with respect to the first and second push rods.

Preferably the actuation mechanism is actuated by a trigger lever connected thereto. A trigger lever is a relatively simple component that can induce an actuation of the actuation mechanism that can moreover be integrated into a housing of the dispenser in a simple way, by e.g. simply hinging it at a pivot point present within the housing.

It should be noted in this connection that the trigger lever is configured to induce the at least substantially linear movement of the driving shaft.

Advantageously the trigger lever is connected to the actuation mechanism via a reducer transmission. Utilizing a reducer transmission to transfer the force applied by the trigger lever to the actuation mechanism means that a higher force can be applied at the first and second drive plate assemblies for a shorter linear displacement of the actuation mechanism.

It is preferred if the reducer transmission comprises a connection part and a gear arm arrangement. In this way the force applied at the first and second drive plate assemblies can be increased to reduce the deflection of the first and second drive plate assemblies.

Preferably the trigger lever and/or the reducer transmission is/are mounted in a housing of the two-component dispenser at at least one pivot point. Pivot points provided in a housing means the design of the two-component system can be simplified reducing the cost of manufacture.

It is preferred if the trigger lever comprises a yoke with the first and second push rods being guided through an opening of the yoke of the trigger lever. In this way the force applied to the trigger lever can be uniformly transmitted in the two-component dispenser. This means that no torsional component is introduced into the force applied which would result in a non-uniform force being applied at the push rods. Moreover, guiding the first and second push rods through the opening present in the yoke means that the construction space of the two-component dispenser can be reduced.

In order to maintain the uniform transmission of force from the trigger lever to the actuation mechanism it is preferred if the gear arm arrangement of the reducer transmission also comprises a yoke with the first push rod being guided through an opening of the yoke of the gear arm arrangement.

In this connection it is preferred if an open end of the yoke of the trigger lever is connected to an open end of the yoke of the gear arm arrangement.

Advantageously this connection is brought about via the connection part that, preferably centrally, connects the yoke present at the gear arm arrangement to the yoke of the trigger lever. In this way a uniform and symmetrical transmission of the force applied at the trigger lever to the actuation mechanism can be achieved.

Preferably the trigger lever and/or the reducer transmission are arranged in or symmetrically with respect to the first plane. In this way all of the components, i.e. the trigger lever, the reducer transmission, e.g. composed of the connection part and the gear arm arrangement, that are involved with bringing about a displacement of the actuation mechanism from the release position into one of the plurality of dispensing positions are symmetrically arranged with respect to the first and second push rods. This means that the components are arranged in the first plane comprising the two push rods or are arranged symmetrically with respect to the first plane comprising both the first and second push rods such that a force induced via the trigger lever is transmitted in a uniform manner to the first and second drive plate assemblies and hence to the first and second push rods via the actuation mechanism.

Advantageously the first and second push rods are guided in front and rear guides, wherein the actuation mechanism is arranged between the front and rear guides. In this way a compact arrangement can be realized. This reduces the size of the two-component dispenser making it simpler to handle.

In order to reduce the cost of manufacture of the respective parts it is advantageous if the front and rear guides are of identical design.

Preferably the rear guide comprises an abutment for the first and second brake plates. In use this abutment aids the positioning of the first and second brake plates and enables these to adopt a brake position in a more efficient manner.

In this connection it should be noted that the front guide comprises an abutment for the trigger lever in the release position of the actuation mechanism.

Advantageously the rear guide is additionally configured as a guide for the actuation mechanism, in particular for the driving shaft of the actuation mechanism.

Providing the rear guide with a guide passage, e.g. a bore, into which a guide member of the driving shaft is inserted, for example, ensures the at least substantially linear movement of the actuation mechanism, particularly when the driving shaft is arranged symmetrically between the first and second push rods in the plane comprising the first and second push rods.

Preferably the respective first and second drive plate assemblies each comprise two plates separated by a spacer, preferably a single piece spacer. Using a dual plate assembly that is separated by a spacer, means that the plates do not leave as severe marks, if at all, on the first and second push rods as a single plate would do. Moreover, a drive plate assembly comprising two plates can cope with higher forces before starting to slide along the push rod making the dispensing action more accurate.

It should be noted in this connection that the spacer employed to separate the two push plates of a respective drive plate assembly is preferably of one-piece design. Moreover, the spacer can be used to also hold the respective plates of the first and second drive plate assemblies with respect to one another and thus act as a drive plate holder. This means that the relative position of all four plates of the first and second drive plate assemblies can be defined and maintained by the spacer on an assembly of the dispenser, respectively on an assembly of the first and second drive plate assemblies at the first and second push rods.

Preferably the respective first and second drive plate assemblies are pre-biased by a retaining device or means (retainer), preferably springs, against the dispensing direction. In this way movement of the first and second drive plate assemblies from the position of engagement at the first and second push rods can be ensured. The use of springs provides a simple form of a retaining device.

It should be noted in this connection that the retaining devices are respectively arranged between the front guide and the first and second drive plate assemblies. In this way the retaining devices, e.g. springs, can be pre-biased between the front guide and the first and second drive plate assemblies.

In a similar way the first and second brake plates can be pre-biased by brake retaining devices or means, preferably springs, in their brake position.

Thus, in a very similar way, the brake retaining devices can be respectively arranged at the first and second push rods between the first and second drive plate assemblies and the first and second brake plates.

In this connection it should be noted that each plate of the drive plate assembly can be of the same design as each brake plate. In this way the manufacturing cost of the respective plates can be reduced even further, as each plate can be of simple design.

It should be noted in this connection that the two-component dispenser can use a variety of identical parts for various components, e.g. the various plates used can be of identical design, the first and second push rods can be of identical design and also the front and rear guides can be of identical design.

Advantageously the two-component dispenser can adopt a neutral state by moving a carriage relative to the actuation mechanism to engage the first and second drive plate assemblies and in which neutral state the first and second drive plate assemblies are respectively arranged releasable with respect to the first and second push rods. In this way the first and second push rods can be retracted from a front end of the two-component dispenser without being locked by either of the first and second drive plate assemblies.

Providing a carriage to bring about a neutral state of the two-component dispenser means that the first and second drive plates can be simultaneously placed into a position in which they no longer lock the first and second push rods. In this connection it should be noted that the carriage is activated close the center of it in a favorable design of the carriage.

Advantageously the two-component dispenser can adopt a neutral state by moving a carriage relative to the actuation mechanism to engage the first and second brake plates and in which neutral state the first and second brake plates are respectively arranged releasable with respect to the first and second push rods. In this way the first and second push rods can be retracted from a front end of the two-component dispenser without being locked by either of the first and second brake plates.

In one design the releasable arrangement is achieved by arranging the first and second brake plates and respectively the first and second drive plate assemblies perpendicular to the first and second push rods, as their apertures are arranged perpendicular to a front face thereof. In another embodiment the apertures in the first and second brake plates and respectively in the first and second drive plate assemblies could be arranged at an inclination with respect to the front face of the first and second brake plates respectively of the first and second drive plate assemblies, so that the releasable arrangement is achieved when the apertures are arranged in parallel to the first and second push rods.

It should also be noted that the carriage can form a component housing for the first and second drive plate assemblies, for the first and second brake plates and for at least some of the actuation mechanism.

In this connection it should be noted that the carriage can be moved to bring the dispenser into the neutral state by a brake lever arrangement, with the brake lever arrangement preferably being pre-biased with respect to the housing and most preferably being able to be locked with respect to the housing in the neutral state of the dispenser and/or in a state which it is not the neutral state of the dispenser, in particular in the dispensing state of the dispenser.

In a further aspect the present invention relates to a use of the dispenser as described herein for the dispensing of sealing agents, adhesives, dental materials, and materials used in the construction field.

BRIEF DESCRIPTION OF THE DRAWINGS

The invention will be explained in more detail hereinafter with reference to the drawings.

DETAILED DESCRIPTION OF THE EMBODIMENTS

Figure 1:
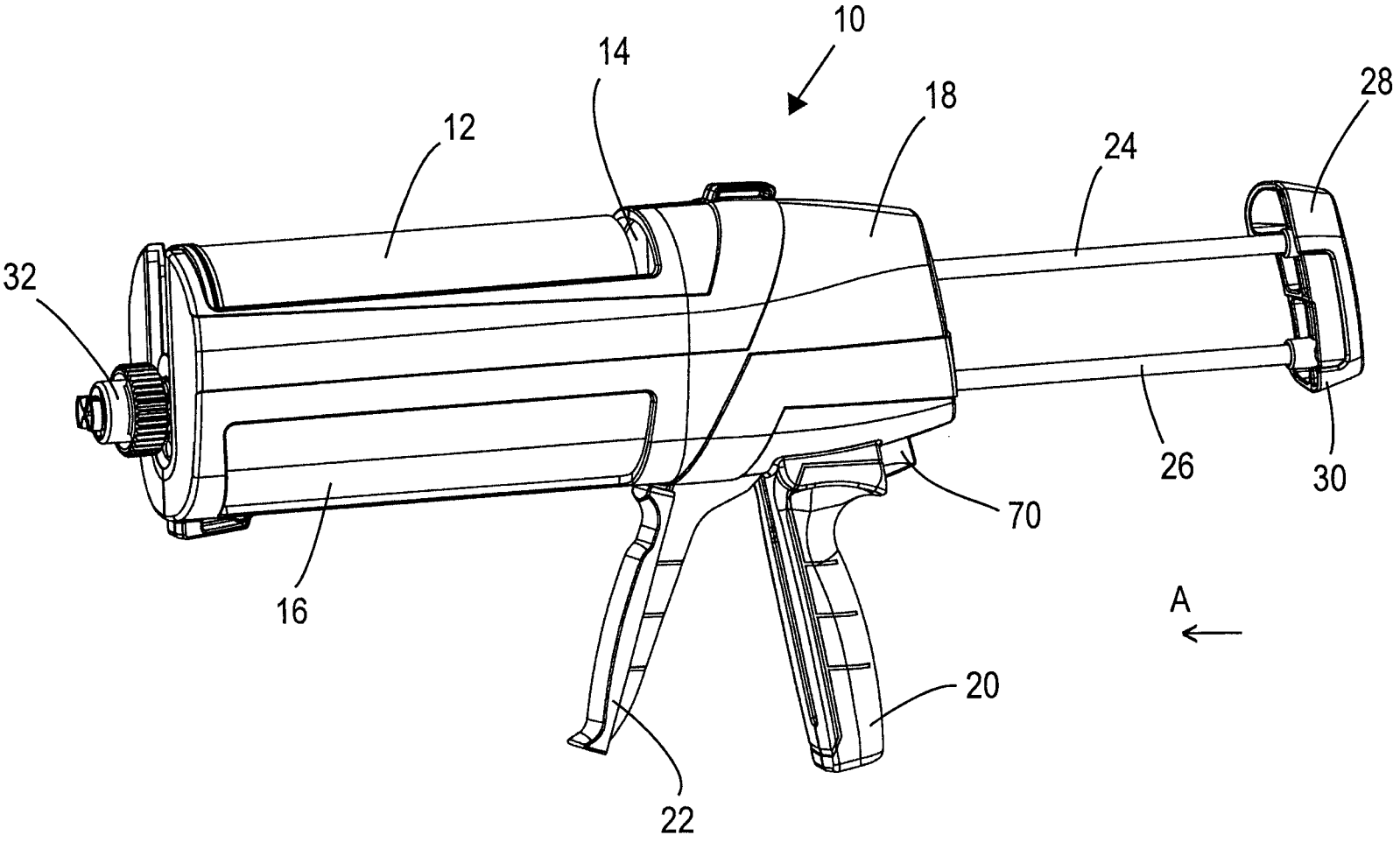
FIG. 1 is a perspective view of a two-component dispenser.

In the following the same reference numerals will be used for parts having the same or equivalent function. Any statements made having regard to the direction of a component are made relative to the position shown in the drawing and can naturally vary in the actual position of application.

FIG. 1 shows a two-component dispenser 10 having a cartridge 12 installed in a receptacle 14 present in the front half 16 of a housing 18 of the two-component dispenser 10. A handle 20 is attached to the housing 18 so that a user (not shown) of the two-component dispenser 10 can hold the two-component dispenser 10.

In order to dispense substances from the cartridge 12 the user can activate a trigger lever 22 in order to effect a movement of first and second push rods 24, 26 (in the following also simply referred to as two push rods 24, 26) in a dispensing direction A. The two push rods 24, 26 are held by a rod handle 28 at the rear end 30 of the two-component dispenser 10.

In use of the cartridge 12 a mixing tip (not shown) will typically be placed at the end of the cartridge 12 currently covered by an end cap 32.

Figure 2:
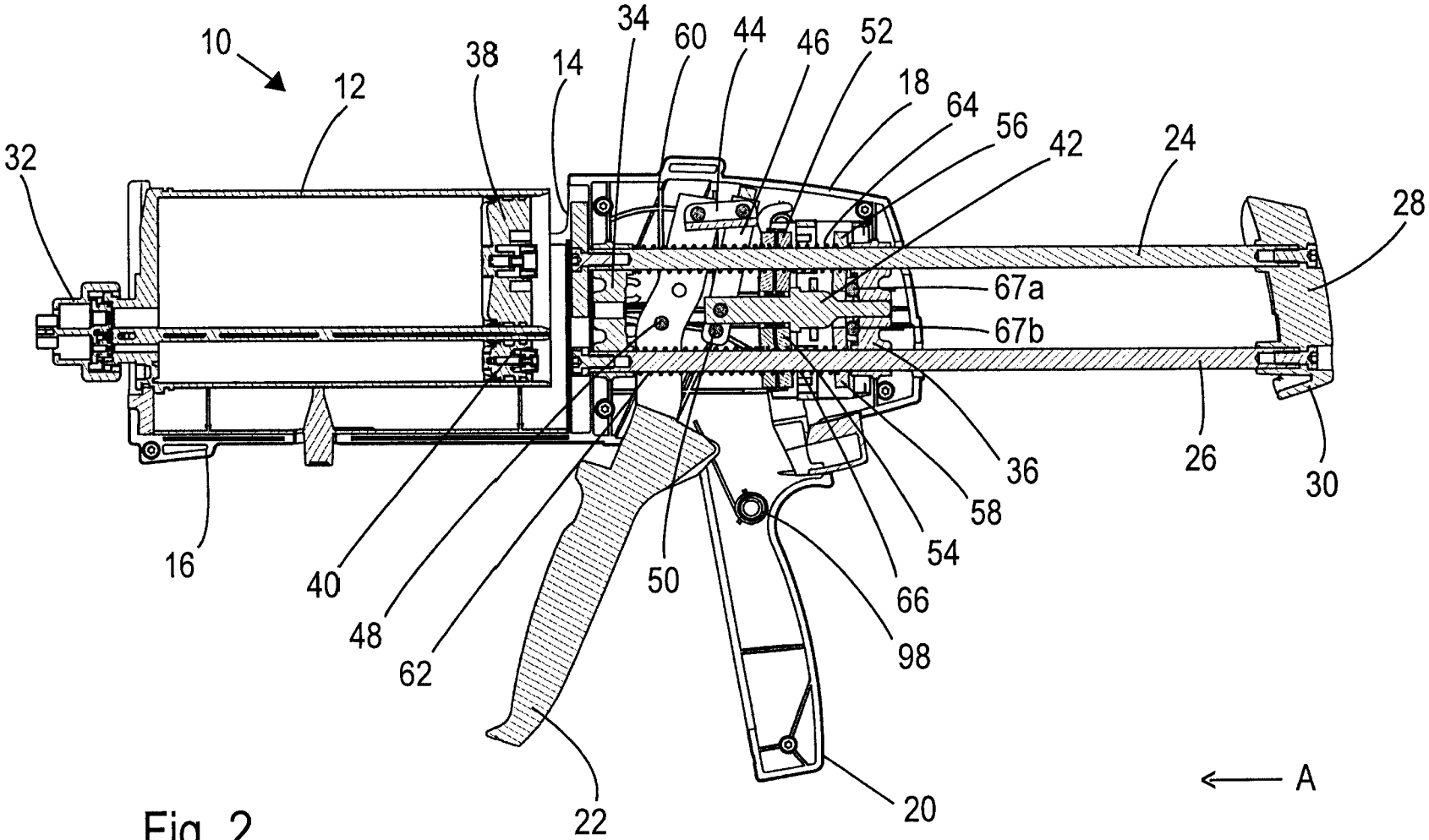
FIG. 2 is a section through the two-component dispenser of FIG. 1.

FIG. 2 shows a section through the two-component dispenser 10 of FIG. 1. The two push rods 24, 26 are guided in front and rear guides 34, 36 in order to engage two pistons 38, 40 present within the cartridge 12. In order to effect a movement of the two push rods 24, 26 in the dispensing direction A, the trigger lever 22 is operatively connected to an actuation mechanism 42 via a connection part 44 and a gear arm arrangement 46 within the housing 18.

The trigger lever 22 and the gear arm arrangement 46 are linked to the housing at respective pivot points 48, 50. On a movement of the trigger lever 22 towards the handle 20, the actuation mechanism (actuator) 42 is displaced in the dispensing direction A, the actuation mechanism 42 thereby engages first and second drive plate assemblies 52, 54 (in the following also simply referred to as two drive plate assemblies 52, 54) that respectively engage the push rods 24, 26 in a locking manner. In this way the two drive plate assemblies 52, 54 are pushed into a position in which they are inclined with respect to the push rods 24, 26 and indeed such that they engage the push rods 24, 26 in a locking or clamping manner therebetween. If the trigger lever 22 is then moved further towards the handle 20, the actuation mechanism 42 is moved further in the dispensing direction A. Due to the locking engagement present between the two drive plate assemblies 52, 54 and the two push rods 24, 26, both the two drive plate assemblies 52, 54 and the two push rods 24, 26 are entrained, i.e. moved, in the dispensing direction A.

In this connection it should be noted that the actuation mechanism 42 can adopt a plurality of dispensing positions between a first dispensing position—in which the two drive plate assemblies 52, 54 are deflected in such a way that they no longer only contact the two push rods 24, 26, but also such that they engage and lock the two push rods 24, 26—and an end dispensing position—in which the trigger lever 22 cannot be moved closer towards the handle 20.

When the actuation mechanism 42 is in a position in which it does not engage the two drive plate assemblies 52, 54, first and second brake plates 56, 58 (in the following also simply referred to as two brake plates 56, 58) are activated and prevent the push rods 24, 26 from traveling in a direction opposite to the dispensing direction A, as will be discussed in the following.

In order to aid the movement of the two drive plate assemblies 52, 54 two springs 60, 62 are respectively arranged between the two drive plate assemblies 52, 54 and the front guide 34.

In a similar way two springs 64, 66 are arranged between the two drive plate assemblies 52, 54 and the two brake plates 56, 58 in order to aid the movement of the brake plates 56, 58.

The two drive plate assemblies 52, 54 and the two brake plates 56, 58 are each floatingly arranged at the push rods 24, 26. This means that the two drive plate assemblies 52, 54 and the two brake plates 56, 58 are not connected to the two push rods 24, 26, but rather are brought into and out of locking engagement with the two push rods 24, 26, through an interaction with the actuation mechanism 42 and/or the respective springs, 60, 62, 64, 66.

In the plurality of dispensing positions of the actuation mechanism 42, the springs 60, 62 are biased with respect to the front guide 34 through the movement of the actuation mechanism 42 in the dispensing direction A. Together with the movement of the actuation mechanism 42, the bias provided by the springs 60, 62 with respect to the two drive plate assemblies 52, 54 ensures that these are inclined with respect to the two push rods 24, 26 in each of the plurality of dispensing positions and namely such that the two drive plate assemblies 52, 54 engage the two push rods 24, 26 in a locking manner.

The bias exerted by the two springs 60, 62 also ensures that the springs 64, 66 are biased between the two drive plate assemblies 52, 54 and the two brake plates 56, 58. The tension on the springs 64, 66 is reduced during the movement of the two push rods 24, 26 and the two drive plate assemblies 52, 54 in the dispensing direction A. At the same time the locking engagement between the two push rods 24, 26 and the two brake plates 56, 58 is released due to the movement of the two push rods 24, 26 in the dispensing direction A.

Once the trigger lever 22 has been released, i.e. is moved away from the handle 20, the actuation mechanism 42 is moved in the direction opposite to the dispensing direction A, so that finally it no longer engages the two drive plate assemblies 52, 54. Thereby the springs 60, 62 push the two drive plate assemblies 52, 54 into an at least substantially vertical position permitting the two drive plate assemblies 52, 54 to release their locking engagement with the two push rods 24, 26 and further move the released drive plate assemblies 52, 54 relative to the push rods 24, 26 against the dispensing direction A into their respective starting position. This movement of the two drive plate assemblies 52, 54 causes the tension on the springs 64, 66 to increase, whereby the springs 64, 66 exert a slight pressure on the two brake plates 56, 58 causing these to engage the push rods 24, 26 in a locking manner. The locked engagement between the two brake plates 56, 58 and the two push rods 24, 26 prevents the push rods 24, 26 from travelling in the direction opposite to the dispensing direction A when the actuation mechanism 42 is in the release position.

In order to aid the locking engagement of the two brake plates 56, 58 with the two push rods 24, 26, the rear guide has two abutments 67*a*, 67*b* about which the two brake plates 56, 58 can pivot when acted on by the springs 64, 66.

In this connection it should be noted that the actuation mechanism 42 is also guided in the rear guide 36. Since the actuation mechanism 42 is guided, at the one hand, within the rear guide 36 and, at the other hand, at the pivot point 50 an approximately linear movement of the actuation mechanism 42 is achieved with respect to the push rods 24, 26. In order to further ensure a substantially linear movement of the actuation mechanism 42 this comprises a linear guide 94 that is moveably arranged in a bore 96 present within the rear guide 36.

Figure 3:
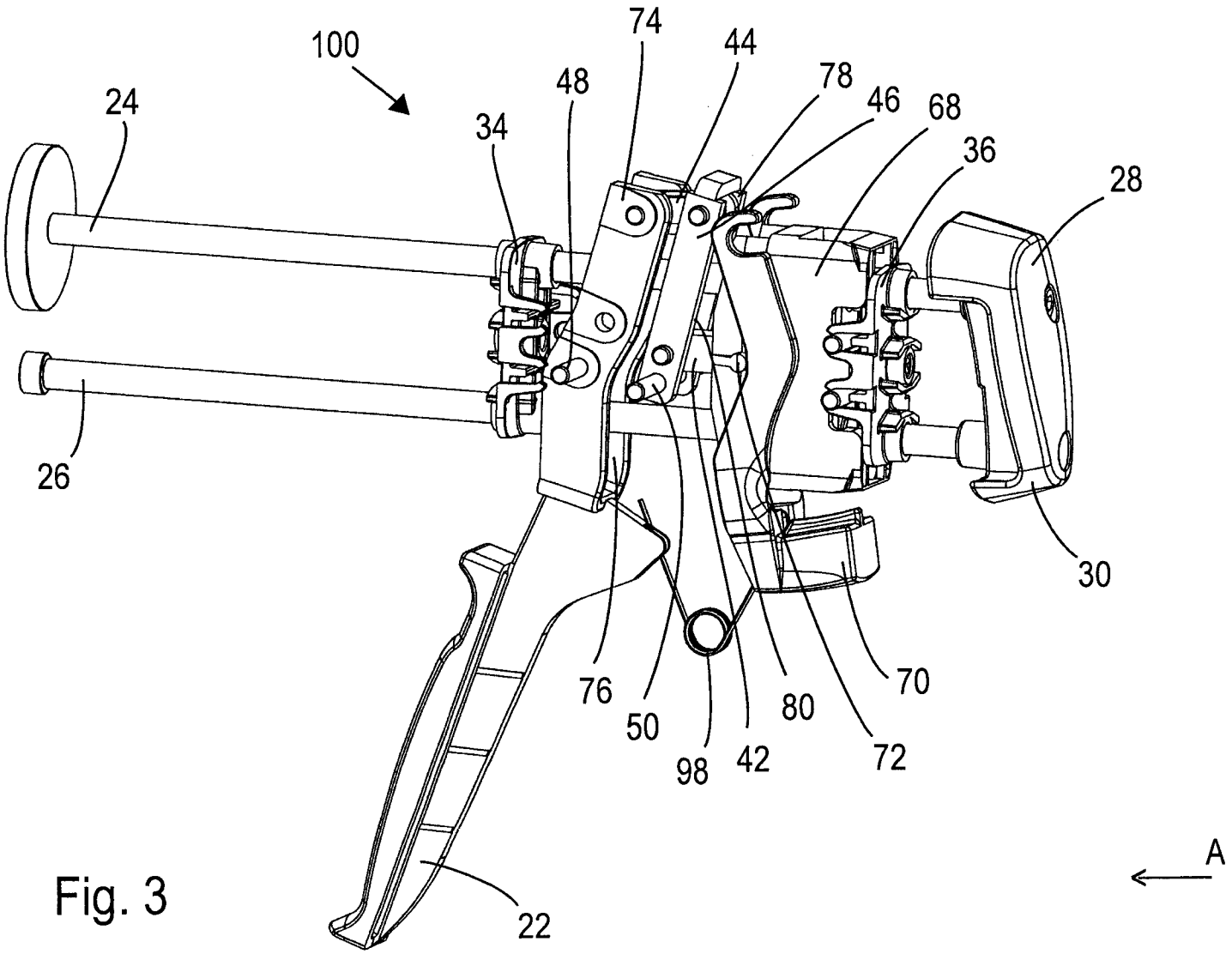
FIG. 3 is a perspective view of some of the internal components of the two-component dispenser

It should further be noted that the trigger lever 22 is biased by a spring 98 mounted at the handle 20. In the view of FIG. 3 one can see that the other end of the spring 98 actually biases a brake release lever 70 and the trigger lever 22 with respect to one another.

FIG. 3 shows a perspective view of some of the internal components of the two-component dispenser that essentially form a so-called dispenser driving mechanism 100.

FIG. 3 further shows a carriage 68 that covers and partly houses the two drive plate assemblies 52, 54 and the two brake plates 56, 58. The carriage 68 includes abutments 92*a*, 92*b*, 92*c*, 92*d* (see FIG. 6) which can engage the two drive plate assemblies 52, 54 and the two brake plates 56, 58 in order to position these in a neutral position so that these no longer engage the push rods 24, 26 (see FIG. 6 in this regard). With the two drive plate assemblies 52, 54 and the two brake plates 56, 58 in their respective neutral position the dispenser 10 is in a neutral state in which the two push rods 24, 26 can be moved in the direction opposite the dispensing direction A to retract the push rods 24, 26 in order to reinstall a cartridge 12 in the receptacle 14 (see FIG. 1).

The carriage 68 can be brought into the corresponding position by moving the brake release lever 70 that is hinged within the housing 18 (see FIG. 1). On movement of the brake release lever 70 this abuts the carriage 68 at centrally arranged pins 72 (of which only one is shown in FIG. 3) in order to move the carriage 68 in the dispensing direction A.

FIG. 3 also shows that the trigger lever has a yoke 74 formed at its end connected to the connection part 44, with the two push rods 24, 26 being guided through an opening 76 of the yoke 74. The gear arm arrangement 46 likewise comprises a yoke 78 at its end connected to the connection part 44 with only one push rod 24 being guided through an opening 80 of the yoke 78 of the gear arm arrangement 46. It should be noted that the pivot point 50 of the gear arm arrangement 46 is asymmetrically arranged between the two push rods 24, 26. In this way a compact design of the dispenser driving mechanism 100 can be achieved.

Figure 4:
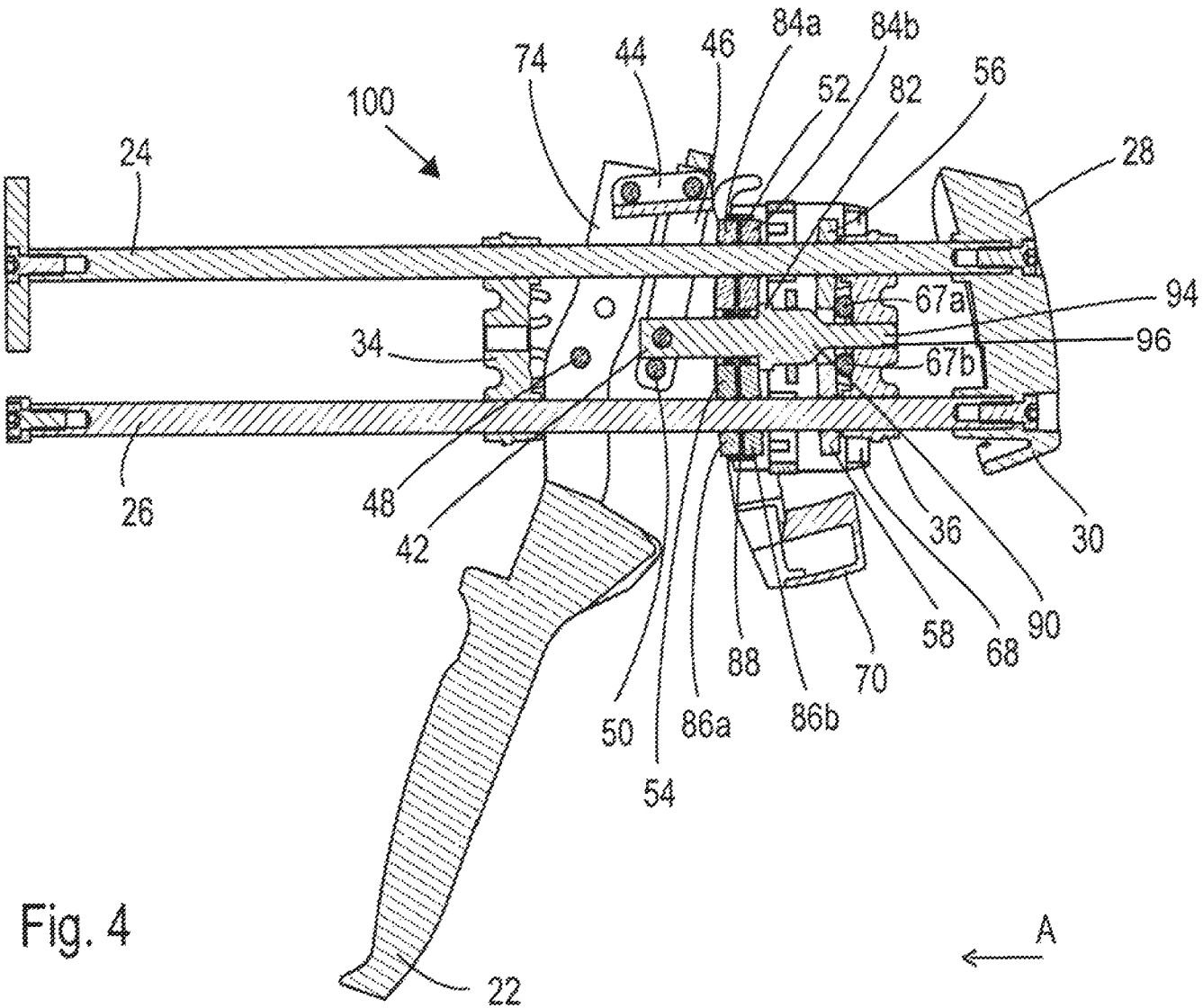
FIG. 4 is a section through the view of FIG. 3 with the actuation mechanism of the two-component dispenser in a release position.

FIG. 4 shows a section through the view of FIG. 3 with the actuation mechanism 42 of the two-component dispenser 10 adopting a release position. In the release position of the actuation mechanism 42, a push member 82 of the actuation mechanism 42 does not engage the two drive plate assemblies 52, 54. In this connection it should be noted that the actuation mechanism 42 is composed of a driving shaft 90 and the push member 82. In the present case the push member 82 is integrally formed with the driving shaft 90.

In this connection it should be noted that the two drive plate assemblies 52, 54 respectively include two plates 84*a*, 84*b*, 86*a*, 86*b* and are connected to one another via a common spacer 88. The spacer 88 also maintains the position of the four plates 84*a,b*, 86*a,b* with respect to one another.

In the release position of the actuation mechanism 42, the two brake plates 56, 58 are respectively inclined with respect to the two push rods 24, 26 due to the interplay of the bias of the springs 64, 66 acting thereon and the abutments 67*a*, 67*b*, thereby preventing a movement of the two push rods 24, 26 against the dispensing direction A.

Figure 5:
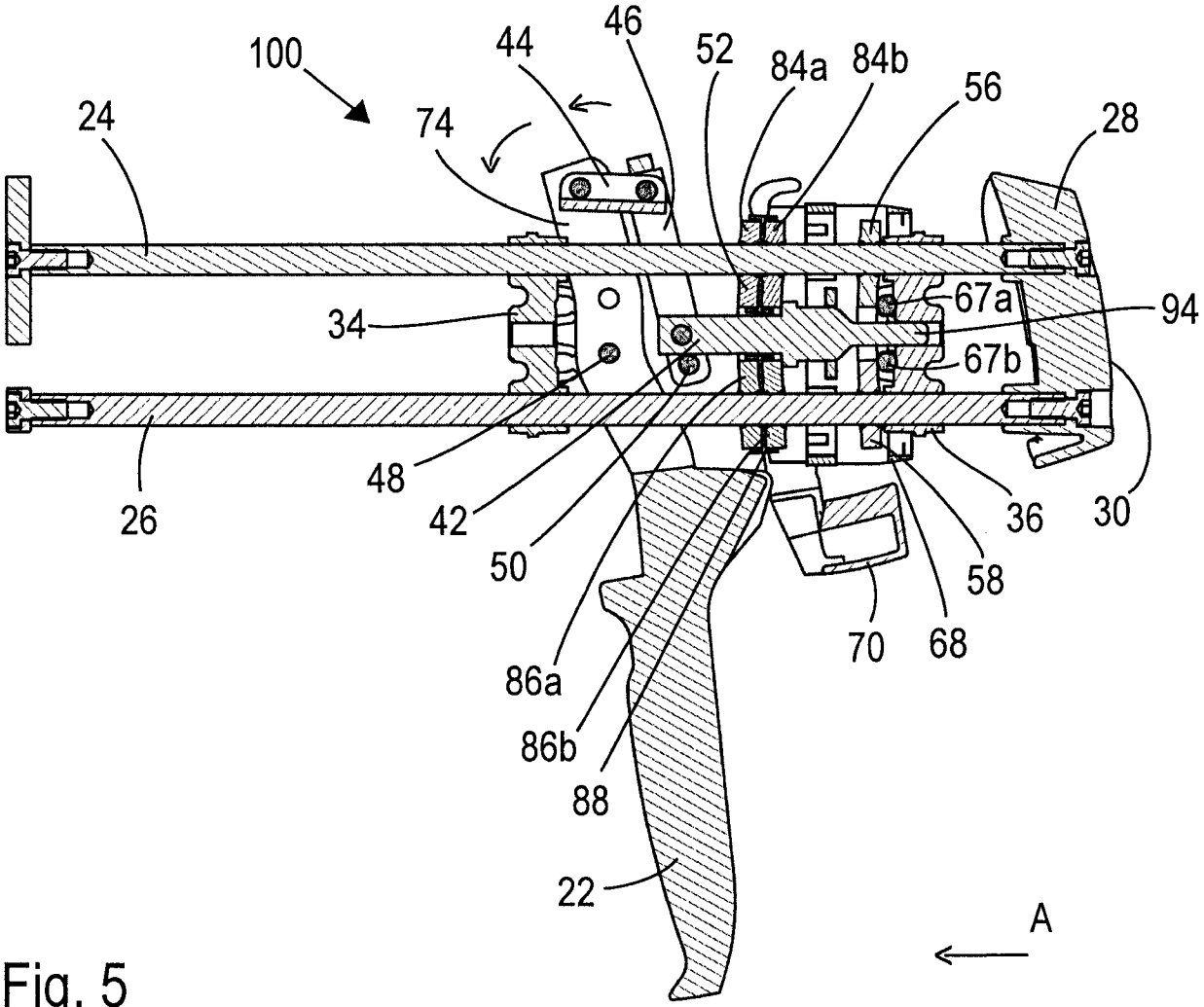
FIG. 5 is a section through the view of FIG. 3 with the actuation mechanism of the two-component dispenser in one of a plurality of dispensing positions.

FIG. 5 shows a section through the view of FIG. 3 with the actuation mechanism of the two-component dispenser adopting one of a plurality of dispensing positions, namely the end dispensing position. In order to bring the push member 82 into engagement with the two drive plate assemblies, the trigger lever 22 is pushed in the direction towards the handle 20 (see FIG. 1), whereby the yoke 74 of the trigger lever 22 is pivoted about the pivot point 48 bringing about a pivot movement at the end of the yoke 74 connected to the connecting part 44 in the dispensing direction A and also at the end of the connecting part 44 where it is connected to the gear arm arrangement 46. This then causes the driving shaft 90 of the actuation mechanism to be pulled in an at least substantially linear manner in the dispensing direction A. The driving shaft 90 hence also pulls the push member 82, present in the form of a push plate, in the dispensing direction A, whereby the push member 82 then engages the two drive plate assemblies 52, 54 symmetrically between the two push rods 24, 26. The two drive plate assemblies 52, 54 thereby deflect with respect to the two push rods 24, 26, i.e. the two drive plate assemblies 52, 54 are moved such that they are inclined with respect to the two push rods 24, 26 and due to the inclination also lock the two push rods 24, 26. As the drive shaft 90 is moved from the first dispensing position to a further dispensing position, here the end dispensing position, in the dispensing direction A, the two push rods 24, 26 are entrained in the dispensing direction A.

A length between the respective pivot points 48, 50 and a respective point of connection of the connection part 44 at the respective yoke 74 and of the yoke 78 determines the reduction in path length the driving shaft 90 can travel and hence the increase in force the push member 82 applies at the two drive plate assemblies 52, 54.

Figure 6:
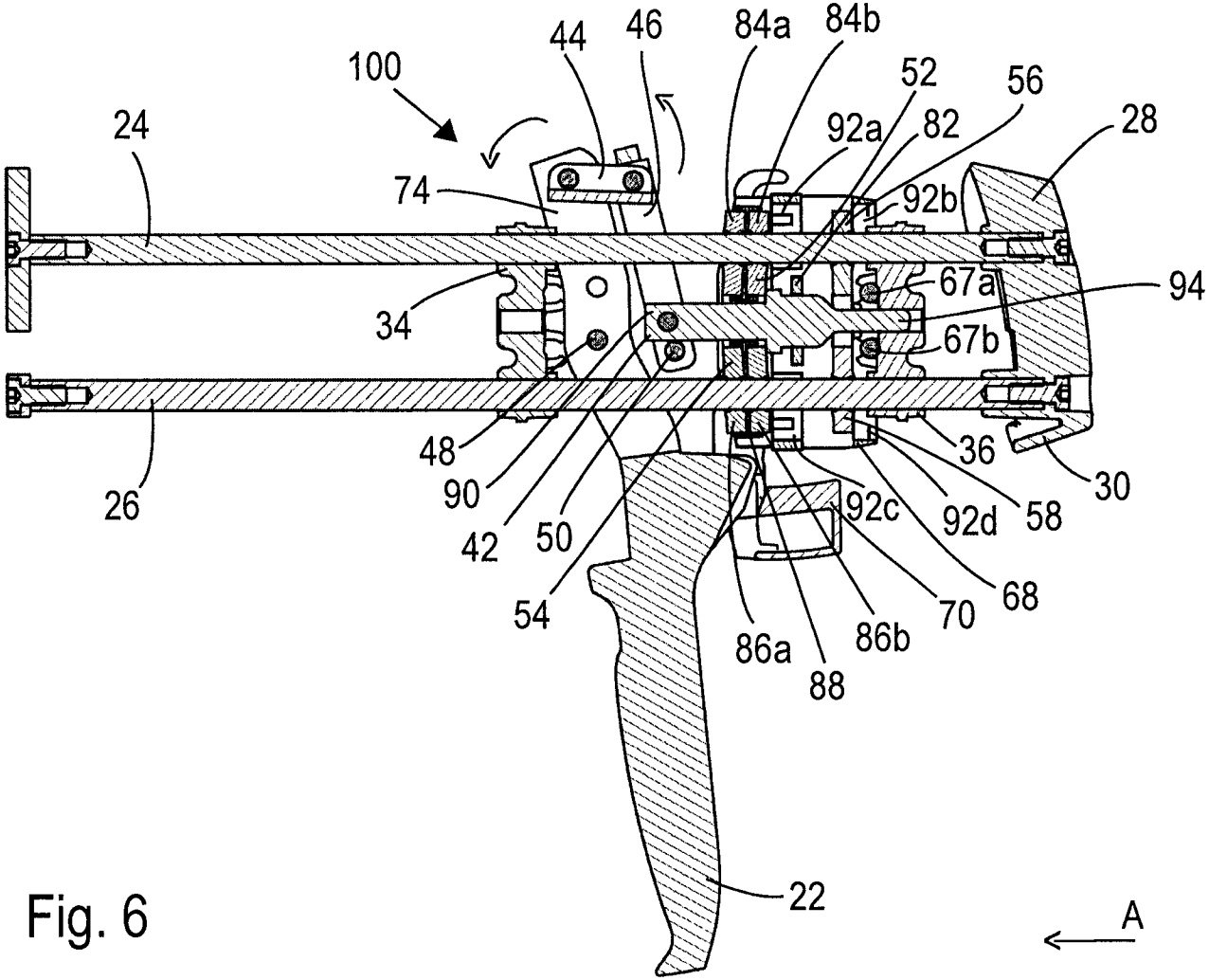
FIG. 6 is a section through the view of FIG. 3 with the two-component dispenser in a neutral state.

FIG. 6 shows a section through the view of FIG. 3 with the two-component dispenser in a neutral state. In the neutral state the brake release lever 70 is pivoted with respect to the housing 18 (see FIG. 1) of the two-component dispenser 10 and engages the pins 72 (see FIG. 3) present at the carriage 68. This causes the carriage 68 to be entrained in the dispensing direction A relative to the two drive plate assemblies 52, 54 and the two brake plates 56, 58. The carriage 68 has abutments 92*a*, 92*b*, 92*c*, 92*d* connected to it in its interior. On a movement of the carriage 68 into the dispensing direction A the abutments 92*a*, 92*b*, 92*c*, 92*d* move the two drive plate assemblies 52, 54 and the two brake plates 56, 58 into their respective neutral position such that their locking contact with the two push rods 24, 26 has been released. Thereby the two push rods 24, 26 can be moved in the direction opposite the dispensing direction A in order to remove a spent cartridge 12.

Moreover, due to the fact that the trigger lever 22 is biased with respect to the brake release lever 70 by the spring 98 (see FIGS. 2 and 3), means that on actuation of the trigger lever 22, the spring 98 causes the brake release lever 70 to maintain its position, i.e. such that it does not move in the direction of the pins 72. Furthermore, on releasing the trigger lever 22 the bias provided by the spring 98 also causes the trigger lever 22 to be pushed back into its position as it is shown e.g. in FIGS. 1 to 4, i.e. in the non-dispensing state.

Through the provision of the spring 98, the spring constant of the springs 60, 62 can be reduced, to ensure that the tension on the two brake plates 56, 58 is slightly reduced on an activation of the trigger lever 22 to permit the movement of the first and second push rods 24, 26 in the dispensing direction A, while maintaining the capability of returning the trigger lever 22 into the non-dispensing state after a dispensing action.

The invention claimed is:

1. A two-component dispenser comprising:

first and second push rods guided within the two-component dispenser;

first and second drive plate assemblies respectively associated with and configured to engage the first and second push rods; and an actuation mechanism symmetrically arranged with respect to the first and second push rods and with respect to the first and second drive plate assemblies, the actuation mechanism configured to be displaced in an at least substantially linear manner between a release position and a plurality of dispensing positions and configured to engage the first and second drive plate assemblies in the plurality of dispensing positions to respectively lock the first and second push rods by engagement with the first and second drive plate assemblies and to entrain the first and second push rods in a dispensing direction of the two-component dispenser.

2. The two-component dispenser in accordance with claim 1, wherein the first and second drive plate assemblies are inclined with respect to the first and second push rods in the plurality of dispensing positions of the actuation mechanism, or a respective first end of the first and second drive plate assemblies engaged by the actuation mechanism is deflected in the dispensing direction and a respective second end of the first and second drive plate assemblies is deflected away from the dispensing direction, so that the first and second drive plate assemblies are deflected in opposite directions.

3. The two-component dispenser in accordance with claim 1, wherein the first and second drive plate assemblies each comprise two plates separated by a spacer, or the first and second drive plate assemblies are pre-biased by retaining devices against the dispensing direction.

4. The two-component dispenser in accordance with claim 1, wherein the two-component dispenser is capable of adopting a neutral state by moving a carriage relative to the actuation mechanism to engage the first and second drive plate assemblies and in the neutral state the first and second drive plate assemblies are respectively arranged releasable with respect to the first and second push rods.

5. The two-component dispenser in accordance with claim 1, wherein the actuation mechanism is arranged in a first plane comprising the first and second push rods.

6. The two-component dispenser in accordance with claim 5, wherein the actuation mechanism is arranged in a second plane or symmetrically with respect to the second plane, the second plane being arranged transversely with respect to the first and second push rods and centrally between the first and second push rods.

7. The two-component dispenser in accordance with claim 1, wherein the actuation mechanism comprises a driving shaft and at least one push member arranged at or integrally formed with the driving shaft, the driving shaft configured to be moved to and fro in an at least substantially linear manner between the plurality of dispensing positions and the release position in parallel to the first and second push rods, and the at least one push member configured to engage the first and second drive plate assemblies in the plurality of dispensing positions of the actuation mechanism.

8. The two-component dispenser in accordance with claim 7, wherein the at least one push member is a push plate.

9. The two-component dispenser in accordance with claim 1, wherein, when the actuation mechanism is in the release position, first and second brake plates respectively lock the first and second push rods with the first and second brake plates and fix the position of the first and second push rods.

10. The two-component dispenser in accordance with claim 9, wherein the two-component dispenser is capable of adopting a neutral state by moving a carriage relative to the actuation mechanism to engage the first and second brake plates and in the neutral state the first and second brake plates are respectively arranged releasable with respect to the first and second push rods.

11. The two-component dispenser in accordance with claim 1, wherein the first and second push rods are guided in front and rear guides and the actuation mechanism is arranged between the front and rear guides.

12. The two-component dispenser in accordance with claim 11, wherein at least one of the rear guides is a guide for the actuation mechanism.

13. The two-component dispenser in accordance with claim 1, wherein the actuation mechanism is actuated by a trigger lever connected thereto.

14. The two-component dispenser in accordance with claim 13, wherein the trigger lever comprises a yoke with the first and second push rods being guided through an opening of the yoke of the trigger lever.

15. The two-component dispenser in accordance with claim 13, wherein the trigger lever is connected to the actuation mechanism via a reducer transmission.

16. The two-component dispenser in accordance with claim 15, wherein the actuation mechanism is arranged in a first plane comprising the first and second push rods, and the trigger lever or the reducer transmission are arranged in or symmetrically with respect to the first plane.

17. The two-component dispenser in accordance with claim 15, wherein the trigger lever or the reducer transmission is mounted in a housing of the two-component dispenser at at least one pivot point.

18. The two-component dispenser in accordance with claim 15, wherein the reducer transmission comprises a connection part and a gear arm arrangement.

19. The two-component dispenser in accordance with claim 18, wherein the gear arm arrangement comprises a yoke with the first push rod guided through an opening of the yoke of the gear arm arrangement.

20. The two-component dispenser in accordance with claim 18, wherein the gear arm arrangement comprises a yoke with the first push rod guided through an opening of the yoke of the gear arm arrangement, and an open end of the yoke of the trigger lever is connected to an open end of the yoke of the gear arm arrangement.

* * * * *